United States Patent [19]

Beck

[11] Patent Number: 4,594,756

[45] Date of Patent: Jun. 17, 1986

[54] METHOD AND APPARATUS FOR PRODUCING A SUBSTRATE COMPOSED SOLELY OF LONGITUDINAL YARNS

[75] Inventor: David A. Beck, Appleton, Wis.

[73] Assignee: Appleton Mills, Appleton, Wis.

[21] Appl. No.: 534,183

[22] Filed: Sep. 20, 1983

[51] Int. Cl.[4] ..... D04H 3/00; D04H 5/02

[52] U.S. Cl. ..... 28/100; 28/110; 28/142; 28/299

[58] Field of Search ..... 28/100, 110, 142, 299; 242/47, 47.03, 47.08, 47.11

[56] References Cited

U.S. PATENT DOCUMENTS

| | | | |
|---|---|---|---|
| 2,232,500 | 2/1941 | Weaver | 242/47.03 |
| 2,525,760 | 10/1950 | Barker . | |
| 2,794,542 | 6/1957 | Vandenburgh et al. | 242/47.03 |
| 2,943,379 | 7/1960 | Foltz, Jr. . | |
| 3,097,413 | 7/1963 | Draper, Jr. . | |
| 3,392,079 | 7/1968 | Fekete . | |
| 3,401,467 | 9/1968 | Koester . | |
| 3,458,911 | 8/1969 | Koester . | |
| 3,459,612 | 8/1969 | Lee et al. . | |
| 3,492,706 | 2/1970 | Lee et al. . | |
| 3,613,258 | 10/1971 | Jamieson . | |
| 3,879,820 | 4/1975 | Grieves et al. . | |
| 3,920,511 | 11/1975 | Grieves et al. . | |
| 4,383,655 | 5/1983 | Ahrendt et al. | 242/47.08 X |

FOREIGN PATENT DOCUMENTS

| | | | |
|---|---|---|---|
| 382490 | 10/1923 | Fed. Rep. of Germany | 28/299 |
| 46-38624 | 11/1971 | Japan | 28/110 |
| 47-46634 | 11/1972 | Japan | 242/47 |
| 594384 | 11/1947 | United Kingdom | 242/47.11 |
| 733651 | 7/1955 | United Kingdom | 242/47.03 |
| 2035396 | 6/1980 | United Kingdom | 242/47.08 |

OTHER PUBLICATIONS

DILO—Plant Type BELTEX 9/79.

*Primary Examiner*—Robert R. Mackey

*Attorney, Agent, or Firm*—Andrus, Sceales, Starke & Sawall

[57] ABSTRACT

A method and apparatus for forming a loop-shaped substrate composed solely of helical wound yarns. An endless winding belt is mounted on a pair of support rolls for travel in an endless path and a plurality of yarns are connected in parallel spaced relation to a threading section disposed along a side edge of the belt. As the belt is driven in its endless path, the yarns are wound on the rolls in a helical pattern. Guide members are located adjacent and upstream each of the rolls and include a plurality of openings to receive and uniformly space the respective yarns. After the group of yarns has been wound in a single convolution, the wound convolution is shifted laterally along the length of the rolls to thereby enable subsequent convolutions of the yarns to be wound on said rolls.

15 Claims, 6 Drawing Figures

FIG. 1
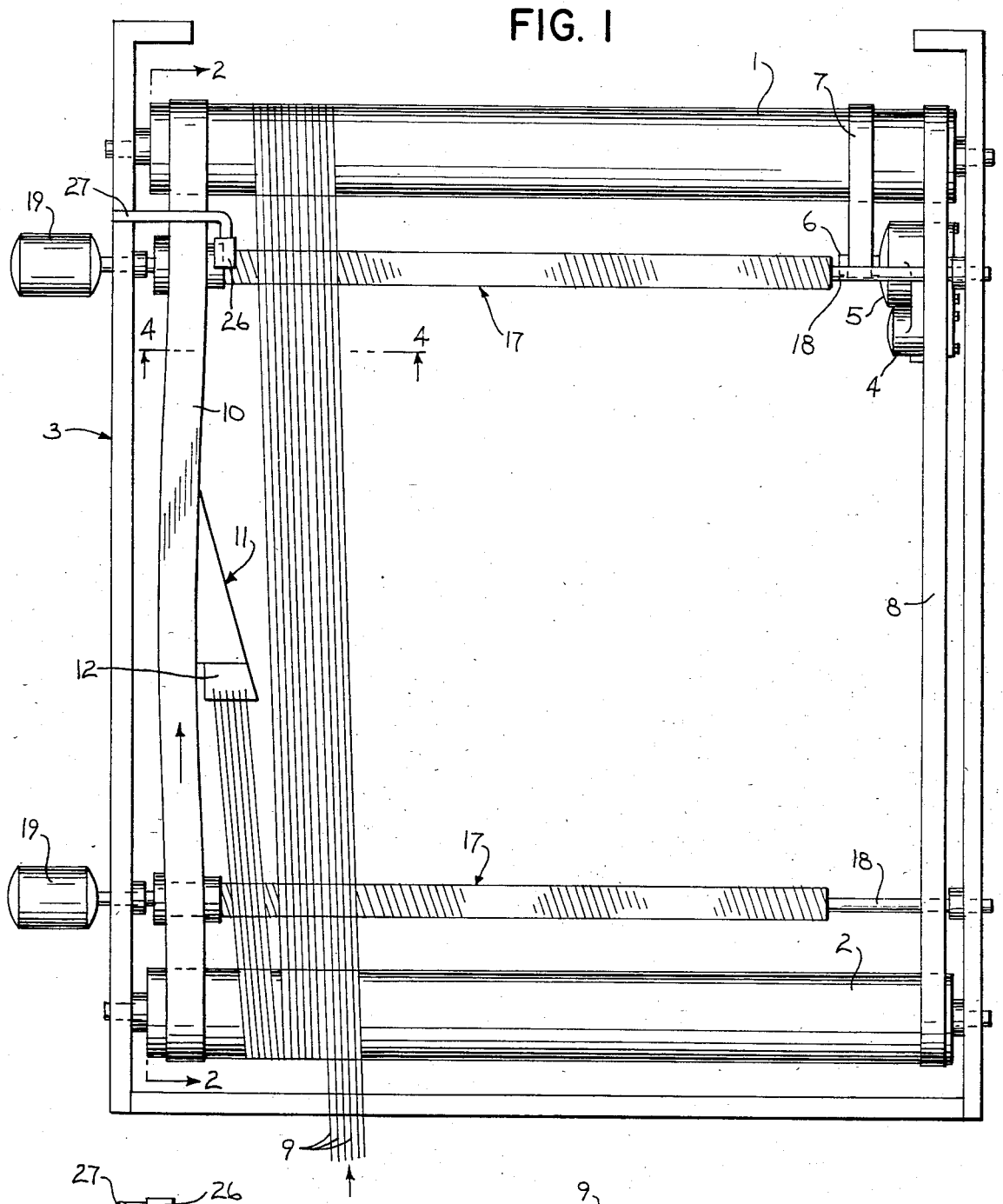
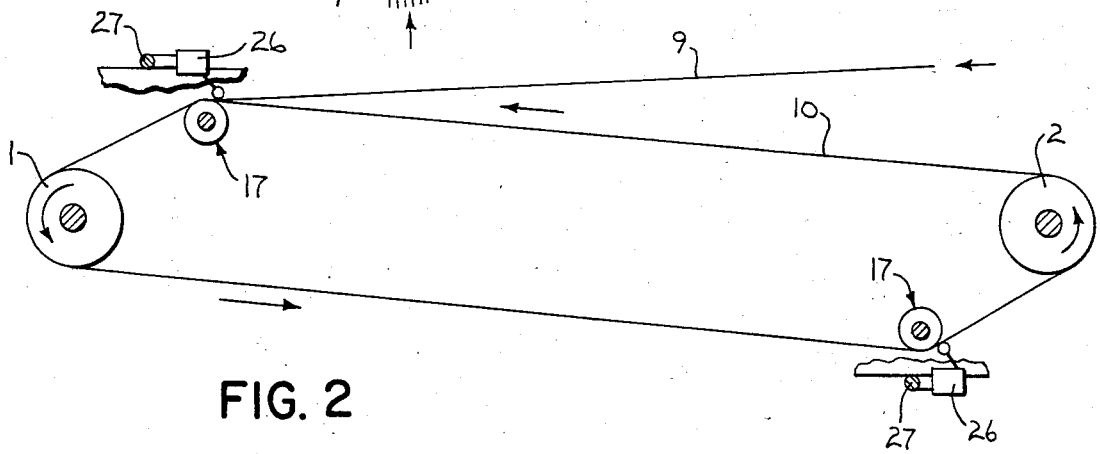
FIG. 2

FIG. 5
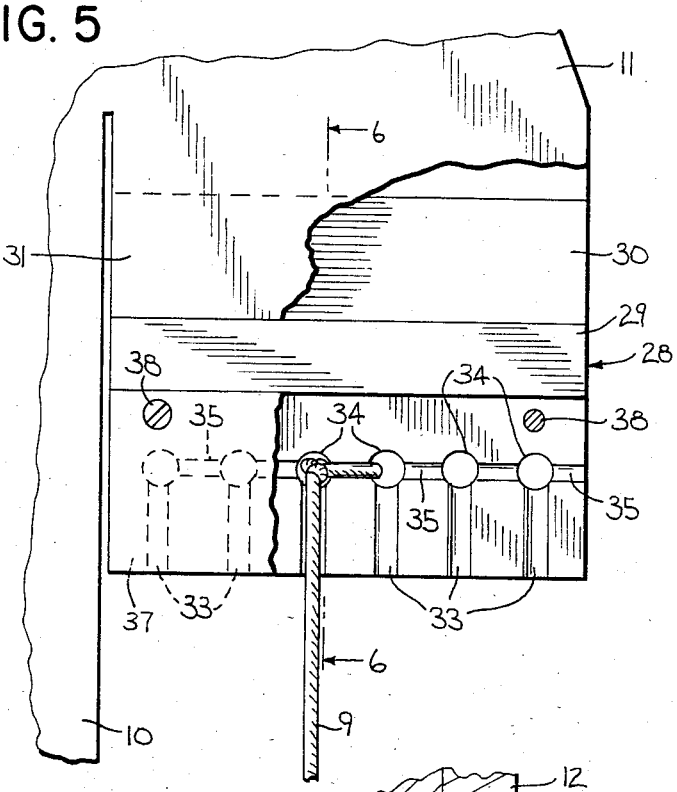
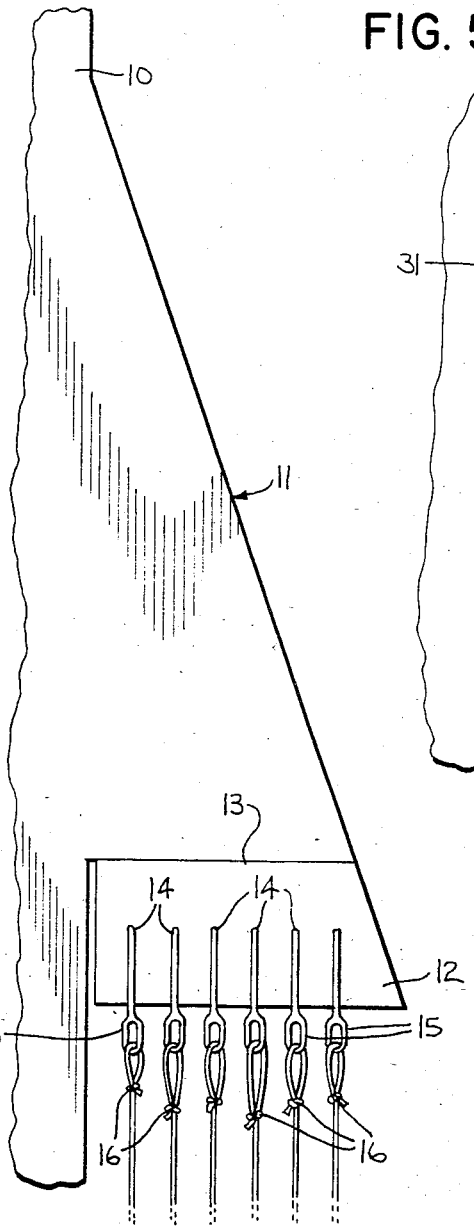
FIG. 3
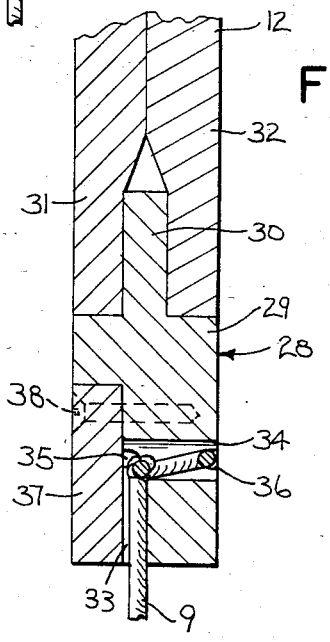
FIG. 6
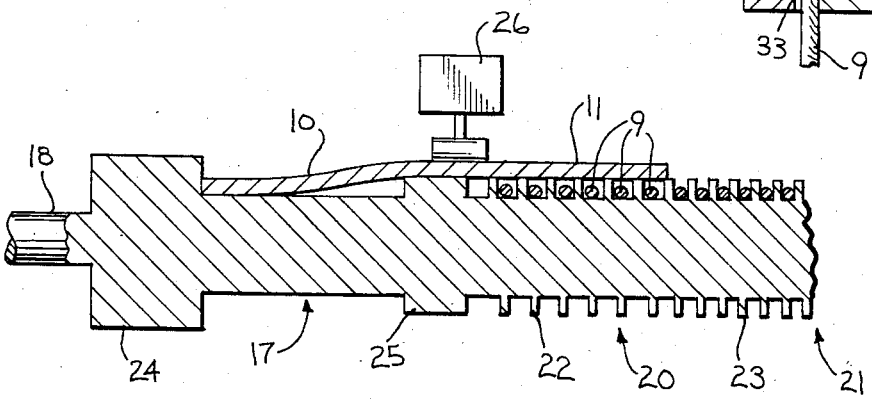
FIG. 4

METHOD AND APPARATUS FOR PRODUCING A SUBSTRATE COMPOSED SOLELY OF LONGITUDINAL YARNS

BACKGROUND OF THE INVENTION

Conventionally, papermaker's felts have been formed by weaving a fabric base and then needling fibrous batts to the base. The use of woven fabric has certain disadvantages. The fabric is normally woven in endless configuration on a loom and due to the size of the felt, a very lengthy set-up time is required before the weaving operation can begin. When fabricating felts of substantial size, it may take a group of workmen several days to set up the loom before weaving can commence. Furthermore, since felts are generally becoming larger, the size of the loom required is also becoming larger.

The shuttle, which is used in the conventional weaving operation to interleaf the cross yarns with the warp yarns, is only capable of containing a limited quantity of yarn and after deletion of the yarn, additional lengths of yarn must then be overlapped with the trailing end of the original length, resulting in pressure points in the completed felt.

As a further problem, the normal weaving process produces distortion of the yarns at the side edges of the woven fabric and non-uniformity in spacing between the yarns. The non-uniformity must normally be corrected through tedious manual operations.

A further disadvantage of utilizing a woven fabric in a papermaker's felt is that the points of crossover between the cross yarns and the warp yarns act as pressure points and can cause disfiguration of the paper web. It has also been recognized that cross yarns impede the drainage characteristics of the felt which can adversely affect the felt's performance on the papermaking machine.

To overcome the disadvantages of the woven base fabric, U.S. Pat. No. 4,495,680, granted Jan. 29, 1985, discloses a method and apparatus for forming a substrate composed solely of machine direction or longitudinal yarns. In accordance with the invention of the aforementioned patent application, a plurality of yarns or strands are drawn from a supply and wound about a pair of parallel rolls in a helical pattern by a traveling winder member. The winding member is connected to a loop which extends around the rolls and the yarns are attached to the trailing end of the winding member. As the rolls rotate, the winding member travels in a helical path around the rolls to thereby draw the yarns from the supply and wind the yarns in a helical pattern about the rolls. Spacing members, such as combs, are located parallel to the rolls and maintain proper spacing and order of the yarns as they are wound about the rolls.

SUMMARY OF THE INVENTION

The invention is directed to an improved method and apparatus for making a loop-shaped substrate or base material consisting solely of helical yarns and which can be used in the manufacture of textile products such as papermaker's felts.

In accordance with the invention, a pair of guide rolls are mounted in parallel spaced relation, and a belt is mounted on the guide rolls and is adapted to travel in an endless path. A group of spaced, generally parallel yarns or strands are connected to a side portion of the belt and extend generally parallel to the direction of travel of the belt. As the belt travels in its endless path, the yarns are drawn from supply creels and wound on the parallel guide rolls.

In the preferred form of the invention, a generally triangular section is attached to one side edge of the belt, or is formed integrally with the belt, and a plurality of connecting members, such as needles, are mounted in parallel relation on the base of the section and the group of yarns is individually attached to the needles. With this connection, the yarns are disposed generally parallel to the length of the belt and are offset laterally from the belt.

In a second form of the invention, the base of the triangular threading section is provided with a series of interconnected internal recesses and the yarns are threaded into the recesses in a manner such that knots connecting the yarns to the threading section are located within the recesses and are not exposed.

Positioned ahead of each guide roll in the direction of travel of the belt, is a guide member having a series of spaced grooves or openings to receive and space the yarns as the belt moves in its endless path. After passing through the guide member, the yarns are carried by the threading section in parallel spaced relation around the adjacent guide roll.

The winding mechanism includes a provision for shifting each covolution of wound yarns along the guide rolls, laterally of the direction of movement of the belt, so that subsequent portions of the yarns can be threaded into the guide members and laid in spaced relation onto the guide rolls. In the preferred form of the invention, the means for shifting the yarns takes the form of a guide member having a helical flight and the spaces between adjacent convolutions of the flight constitute the threading grooves or openings to receive the yarns.

The helical flight is composed of a threading section and a storage section. The pitch of the threading section is greater than that of the storage section so that the yarns can be readily threaded into the grooves in the threading section and any knots conecting the yarns to the endless belt will not interfere with the threading. When the helical flight is rotated, the threaded yarns will be shifted or moved into the storage section of the flight in which the spacing between the grooves is reduced so that the wound convolutions of the yarns will be maintained in close proximity. Rotating the helical flight to move the yarns from the threading grooves to the storage grooves will correspondingly shift the wound yarns longitudinally along the guide rolls.

A mechanism is included to intermittently rotate the helical flight a sufficient number of revolutions to move the threaded yarns to the storage section of the helical flight. After the threaded yarns have been shifted to the storage section, rotation of the helical flight is terminated to permit successive portions of the yarns to be threaded in the threading section of the helical flight in succeeding passes.

The invention produces a substrate composed solely of longitudinal yarns in endless form and having the desired length and width, so that no splicing of yarns is required in order to produce the endless configuration.

Other objects and advantages will appear in the course of the following description.

DESCRIPTION OF THE DRAWINGS

The drawings illustrate the best mode presently contemplated of carrying out the invention.

In the drawings:

FIG. 1 is a top plan view of the apparatus of the invention;

FIG. 2 is a section taken along line 2—2 of FIG. 1;

FIG. 3 is an enlarged fragmentary top plan view of the winding belt showing the gusset and the attachement of the yarns;

FIG. 4 is a section taken along line 4—4 of FIG. 1, and showing the helical transfer member;

FIG. 5 is a top plan view with parts broken away in section of a modified form of the connection mechanism for connecting the yarns to the endless belt; and FIG. 6 is a section taken along line 6—6 of FIG. 5.

DESCRIPTION OF THE ILLUSTRATED EMBODIMENT

FIG. 1 in schematic form illustrates the apparatus of the invention for producing an endless or loop-shaped substrate formed solely of helical yarns or strands. The substrate can subsequently be used to produce a wide variety of textile products and has particular application in producing a papermaker's felt.

The apparatus for producing the substrate includes a pair of generally parallel guide rolls 1 and 2, which are journaled for rotation in a frame or supporting structure 3.

One of the rolls 1 is driven by a drive mechanism that includes a motor 4 which operates through gear box 5. The output shaft 6 of the gear box is connected by a belt drive 7 to roll 1 to thereby rotate the roll. Rolls 1 and 2 are driven in synchronrization by a drive belt 8 which connects rolls 1 and 2. Alternately, roll 2 can be driven by a separate motor and operated in synchronization with roll 1.

In accordance with the invention, a group of yarns or strands 9 are contained on a creel, not shown, and are adapted to be wound around the rolls 1 and 2 in a generally helical pattern to provide the endless or looped substrate.

The term "yarn" as used in the specification and claims is intended to include strands of monofilament, multi-filament, fiber materials, or mixtures of these materials, in either twisted, untwisted, intertwined or plied forms. The yarns can be formed of any desired material, such as wool or synthetic materials.

Yarns 9 are wound about rolls 1 and 2 through operation of an endless winding member 10 which, as illustrated in the drawings, can take the form of a belt.

As shown in FIG. 1, a generally triangular threading section 11 is attached to a side edge of belt 10, or alternately, is formed integrally with the belt and the base or trailing end of the section, in the direction of movement of belt 10, defines a flap 12 which is un-attached to the side edge of the belt and can pivot with respect to the body portion of the gusset along the hinge line 13.

The individual yarns 9 are connected in spaced parallel relation to flap 12 of gusset 11 by connectors which, as shown in FIG. 3, take the form of needles 14. The ends of yarns 9 are passed through the eyes 15 of the respective needles and are tied back to the yarns by knots 16.

Driving of rolls 1 and 2 by the drive belt 8 will correspondingly move the winding belt 10 in its endless path of travel to draw the yarns 9 from the creels and wind the yarns in parallel relation on the rolls 1 and 2.

In accordance with the invention, a guide member 17 is located upstream (with respect to the direction of travel of belt 10) from each of the rolls 1 and 2. In practice, the guide member 17 can be located upstream ½ to 2 times the length of triangular threading section 11 from the respective roll. In the preferred form of the invention, the guide members 17 take the form of helical flights and the shafts 18 of the guide members 17 are suitably journaled in frame 3. Each guide member can be selectively rotatively positioned through operation of a drive mechanism, shown schematically as electric motor 19, which is connected to the respective shaft 18 of the guide member.

Guide members 17 are identical in construction and are preferably formed of finned tubing. As best illustrated in FIG. 4, each guide member 17 includes a threading section 20 and a storage section 21. Threading section 20 includes a helical flight 22 which has a pitch considerably greater than the pitch of the flight 23 of storage section 21.

To guide the winding belt 10 in travel, each guide member 17 is provided with a pair of collars 24 and 25 and the space between the collars defines a groove or track to receive the belt 10. As best illustrated in FIG. 4, the collar 24 has a substantially greater height than collar 25 and the outer diameter of collar 25 corresponds generally to the outer diameter of helical flight 22.

As the winding belt 10 travels in its track defined by collars 24 and 25 and approaches the guide member 17, the triangular section 11 will ride upwardly over the collar 25 of the guide member, which at this time is stationary and not rotating. As the flap 12 of section 11 approaches the guide member, the yarns 9 will drop into the spaces or grooves between the convolutions in helical flight 22 of threading section 20. After the yarns have been deposited within the grooves in helical flight section 22, a mechanism is provided to operate motor 19 to rotate the guide member 17 to thereby shift or convey the yarns 9 along the length of the guide member and into the grooves in the flight 23 of storage section 21. To actuate the motor 19, a limit switch 26 is mounted on bracket 27 above and slightly downstream of the guide member 17 in a position where it will be contacted by section 11 as the section rises and moves over the collar 25. Tripping of the arm of switch 26 will operate the motor 19 to produce a predetermined number of revolutions of guide member 17 to transfer or shift the yarns 9 laterally to the storage section 21 so that in the next pass of section 11, subsequent portions of the yarns can be wound in the helical flight 22 of threading section 20.

The greater pitch of the threading flight 22 as compared to the storage flight 23, facilitates threading of the yarns into the grooves between adjacent convolutions of the flight and insures that knots 16 will freely pass through the grooves. In addition, the greater pitch allows wider tolerances for threading and greatly enhances the runability of the winding system. By reducing the pitch of the storage flight 23, the wound yarns will be maintained in close proximity for subsequent use.

The drawings illustrate six yarns 9 being wound, but it is contemplated that any desired number of yarns can be attached to section 11 and wound on rolls 1 and 2. Utilizing six yarns, the guide member 17 is rotated six revolutions to transfer the six wound yarns laterally so that the first six convolutions of the helical flight 22 will be free of yarns and thus can receive subsequent yarns in the second pass. If, on the other hand, twenty yarns 9 were being wound, the guide member 17 would be programmed to index twenty revolutions to shift the threaded yarns to the storage section 21 before the next pass.

As the rolls 1 and 2 are smooth surfaced, shifting of the yarns 9 by the helical guide members 17 will correspondingly move the yarns in spaced relation along the rolls 1 and 2.

The triangular threading section 11 provides several distinct functions. Not only does it form a means for attaching the yarns 9 to the winding belt 10, but due to its triangular configuration prevents twisting of the belt when tension is applied to the yarns 9. As a further advantage, the location of the attachment of the yarns to the base of the section causes the section to skew as it travels between the rolls 1 and 2 and thus tends to move the portion of the belt to which the section is attached outwardly away from the previously wound substrate, as shown in FIG. 1, so there is no possibility of the section contacting and distrupting the orientation of the previously wound yarns. In addition, the hinge 13 between the base or flap 12 of the section and the body of the section permits the gusset to more nearly conform to the curvature of rolls 1 and 2 as it passes over the rolls. To insure proper threading, the length of triangular section 11 should be 2 to 20 times the width of base 12.

While the drawings illustrate a single threading section 11 associated with belt 10, it is contemplated that a series of sections 11 can be mounted in spaced relation on belt 10, in which case the guide member 17 would be operated each time a threading section 11 passed thereover.

The invention produces an endless substrate consisting solely of machine direction helically wound yarns in any desirable length and width. Because the substrate is wound in endless or loop form, the time consuming and expensive operation of splicing yarns to form an endless configuration is totally eliminated.

As the system is capable of winding a multiplicity of yarns, as opposed to winding a single yarn or end, the overall production time for producing the substrate is substantially reduced.

FIGS. 5 and 6 illustrate an embodiment of the invention in which a modified form of connector is employed to connect the yarns 9 to the gusset 11. As shown in FIG. 5, the connector 28 includes an elongated plate 29 having a tongue 30 which is secured between two layers 31 and 32 of gusset flap 12. As shown in FIG. 5, the rear end of plate 29 is formed with a plurality of parallel recesses or slots 33, the inner ends of which communicate with holes 34 which extend through the plate.

The adjacent upper ends of holes 34 are connected by cross passages 35, while the lower ends of adjacent holes are connected by cross passages 36. To complete the assembly, a top bar 37 can be connected to the upper surface of the plate by screws 38 or the like.

To connect each yarn 9 to the connector 28, the yarns is dropped into passages 33 and the end of the yarn is then inserted downwardly through the corresponding hole 34, then passed laterally through cross passages 36 and back up through the adjacent hole 34, continuing on back through passage 35, and then tied with a knot to the incoming yarn 9, leaving the knot in passage 34. After threading all of the yarns 9 in this manner, the top bar 37 is assembled. Through this manner of threading, all of the knots are enclosed and there are no exposed knots on the yarn 9. By enclosing the knots, it is possible to reduce the pitch of the helical flight 22 of guide members 17 over a system having exposed knots.

The apparatus of the invention produces a looped or endless substrate composed solely of machine direction yarns and can subsequently be needled with fibrous batting to produce all or a part of a papermaker's felt, or other fabric. The needling operation can be carried on directly on the winding apparatus or alternately, the array of helical yarns can be removed from rolls 1 and 2 and subsequently installed on a conventional needling machine. Pressure sensitive adhesive tape can be spread transversely across the array of helical yarns to maintain the proper spacing if the yarns are to be transferred to a needling machine.

Through use of the invention, the time for producing the substrate can be greatly reduced over conventional weaving methods.

Various modes of carrying out the invention are contemplated as being within the scope of the following claims particularly pointing out and distinctly claiming the subject matter which is regarded as the invention.

I claim:

1. An apparatus for producing a loop-shaped substrate composed solely of helical wound yarns, comprising a pair of support members, an endless winding member mounted on the support members for travel in an endless path, means for preventing movement of said endless winding member longitudinally of said support members, a plurality of yarns, connecting means for connecting the yarns in generally parallel relation to a side portion of said winding member, said yarns being disposed generally parallel to the direction of travel of said winding member, drive means to drive the winding member in said path of endless travel to thereby wind said yarns on said support members in a helical pattern, guide means spaced between said support members and having generally parallel yarn receiving receptacles extending generally parallel to the direction of travel of said endless member, and transfer means acting in synchronization with said winding member for shifting the feed point of the wound yarns along said support members in a direction lateral of the direction of movement of said winding member to thereby enable additional portions of said yarns to be wound on said support members in a subsequent pass.

2. The apparatus of claim 1, wherein said guide means comprises a helical flight with spaces between adjacent convolutions of said flight constituting said receptacles, and said transfer means for shifting comprises second drive means to rotate the helical flight in a direction to move the yarns longitudinally of the axis of said flight, said support members having smooth outer surfaces to permit said yarns to shift laterally of the direction of travel of the winding member.

3. The apparatus of claim 2, wherein said helical flight includes a first threading section and a second storage section, the helical flight on said threading section having a greater pitch than the flight on said storage section, said threading section being disposed in alignment with the path of travel of said connecting means so that said yarns will be received within the spaces between the convolutions of the flight of said threading section.

4. The apparatus of claim 2, and including sensing means for sensing the deposit of said yarns in said spaces for operating said second drive means to rotate said flight and shift said yarns.

5. The apparatus of claim 1, wherein said connecting means comprises a generally triangular section attached to the side portion of said endless winding member, one end of said section having a pointed tip facing in the direction of travel of said winding member and the opposite end of said section extending laterally from said winding member, said yarns being connected to said opposite end.

6. The apparatus of claim 5, wherein said section comprises a body portion secured to the side portion of said winding member and a base portion hinged to said body portion and unattached to said winding member.

7. The apparatus of claim 6, and including a plurality of connectors disposed in spaced relation on said base portion, each of said connectors having an opening to receive one of said yarns.

8. The apparatus of claim 1, and including means responsive to the yarns being received within said receptacles for operating said transfer means to shift the wound yarns along said support members.

9. An apparatus for producing a loop-shaped substrate composed solely of helical wound yarns, comprising a pair of guide rolls, an endless belt mounted on the guide rolls for travel in an endless path, means for preventing movement of said belt longitudinally of said guide rolls, a plurality of yarns, connecting means for connecting the yarns in generally parallel spaced relation to a side portion of said belt, said yarns being disposed generally parallel to the direction of travel of said belt, drive means to drive the belt in said path of endless travel to thereby wind the yarns on said rolls in a helical pattern, a helical flight disposed adjacent at least one of said rolls, the spaces between adjacent convolutions of said flight constituting recesses disposed to receive said yarns, said helical flight extending transversely with respect to the direction of travel of said belt, second drive means operably connected to said helical flight for rotating the flight in a direction to move the yarns contained within said spaces longitudinally of the axis of said flight, and sensing means for sensing the deposit of said yarns in said spaces for operating said second drive means to intermittently rotate said flight and shift said yarns, said helical flight being stationary when yarns are deposited in said spaces in the next subsequent pass of said belt.

10. The apparatus of claim 9, wherein said connecting means comprises a generally triangular section extending laterally of said belt, said section having a pointed tip facing in the direction of travel of said belt and having a base extending laterally from a side edge of the belt, said yarns being connected in spaced relation to said base.

11. The apparatus of claim 9, wherein said helical flight includes a yarn threading section and a yarn storage section, said yarns being received in said spaces in the threading section and subsequently being moved into said spaces in said storage section.

12. The apparatus of claim 11, wherein the pitch of the flight in said threading section is greater than the pitch of the flight in said storage section.

13. A method of forming an endless substrate composed solely of longitudinally extending yarns, comprising the steps of mounting an endless belt around a pair of spaced generally parallel support members, connecting a plurality of yarns to a side edge portion of said belt, driving the belt in endless path to thereby wind the yarns on the support members in a helical pattern, maintaining said belt in a fixed path of endless travel on said support members, positioning said yarns during movement of said belt in lateraly spaced relation in a guide receptacle, and moving the receptacle to shift the feed point of the wound yarns along the support members in a direction lateral to the direction of movement of said belt to thereby enable additional portions of said yarns to be wound on said support members in a subsequent pass.

14. A method of forming an endless substrate composed solely of longitudinally extending yarns, comprising the steps of mounting an endless belt around a pair of spaced support members, connecting a plurality of yarns in spaced relation to a side edge portion of said belt, driving the belt in an endless path to thereby wind the yarns on the support members in a helical pattern, preventing movement of the belt longitudinally of said support members, mounting a helical flight adjacent and generally parallel to at least one of said support members with the spaces between adjacent convolutions of said flight being yarn receiving recesses, separately depositing the yarns into said recesses as said belt moves in its path of travel, maintaining the helical flight in a generally stationary condition as the yarns are deposited in said recesses, rotating said helical flight in a direction to transfer the yarns contained within said recesses longitudinally along said flight to a storage location to enable additional portions of said yarns to be received within said recesses in a subsequent pass, and terminating the rotation of said flight after said yarns have been transferred to a storage location so that said flight will be stationary when said yarns are deposited in said recesses in the next subsequent pass.

15. The method of claim 14, and wherein the helical flight is rotated a number of revolutions corresponding to the number of yarns.

* * * * *